US011034170B2

(12) United States Patent
Bhatt et al.

(10) Patent No.: US 11,034,170 B2
(45) Date of Patent: Jun. 15, 2021

(54) RECORDING MEDIUM IDENTIFICATION

(71) Applicant: HEWLETT-PACKARD DEVELOPMENT COMPANY, L.P., Spring, TX (US)

(72) Inventors: Jayprakash C. Bhatt, Corvallis, OR (US); Matthew Thornberry, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/606,975

(22) PCT Filed: Jul. 13, 2017

(86) PCT No.: PCT/US2017/041913
§ 371 (c)(1),
(2) Date: Oct. 21, 2019

(87) PCT Pub. No.: WO2019/013801
PCT Pub. Date: Jan. 17, 2019

(65) Prior Publication Data

US 2020/0047523 A1 Feb. 13, 2020

(51) Int. Cl.
*B41J 11/00* (2006.01)

(52) U.S. Cl.
CPC ..... *B41J 11/009* (2013.01)

(58) Field of Classification Search
CPC ..... B41J 11/009
See application file for complete search history.

(56) References Cited

U.S. PATENT DOCUMENTS

| | | | | |
|---|---|---|---|---|
| 5,053,826 | A | 10/1991 | Castelli et al. | |
| 6,325,505 | B1 | 12/2001 | Walker | |
| 8,085,411 | B2 | 12/2011 | Kai et al. | |
| 9,162,491 | B2 | 10/2015 | Mindler et al. | |
| 9,387,696 | B2 | 7/2016 | Fliratseka et al. | |
| 9,481,186 | B2 | 11/2016 | Bouverie | |
| 2007/0076074 | A1 | 4/2007 | Zhang et al. | |
| 2012/0139986 | A1 | 6/2012 | Powers et al. | |
| 2016/0031250 | A1 * | 2/2016 | Yokozawa | B41J 11/009 347/19 |

FOREIGN PATENT DOCUMENTS

| | | | |
|---|---|---|---|
| EP | 1329325 | | 7/2003 |
| EP | 1727095 | | 11/2006 |
| EP | 2371562 | | 10/2011 |
| JP | 2016215452 | A * | 12/2016 |
| RU | 2329288 | | 7/2008 |
| RU | 100347 | | 12/2010 |

* cited by examiner

*Primary Examiner* — Jason S Uhlenhake
(74) *Attorney, Agent, or Firm* — Dierker & Kavanaugh PC

(57) ABSTRACT

In an example of recording medium identification method, a digital image of a line or a dot printed on a recording medium with a printer is captured by an image sensor. From the digital image, a microprocessor (operatively connected to the image sensor), digitally measures a width of the line, a diameter of the dot, an area of the dot, or a perimeter of the dot. The microprocessor identifies a type of the recording medium based on the width, the diameter, the area, or the perimeter. In response to the identification of the type of the recording medium, a print setting for the type of the recording medium is selected.

10 Claims, 5 Drawing Sheets

RECORDING MEDIUM IDENTIFICATION

BACKGROUND

In addition to home and office usage, inkjet technology has been expanded to high-speed, commercial and industrial printing. Inkjet printing is a non-impact printing method that utilizes electronic signals to control and direct droplets or a stream of ink to be deposited on media. Some commercial and industrial inkjet printers utilize fixed printheads and a moving substrate web in order to achieve high speed printing. Current inkjet printing technology involves forcing the ink drops through small nozzles by thermal ejection, piezoelectric pressure or oscillation onto the surface of the media. This technology has become a popular way of recording images on various media surfaces (e.g., paper), for a number of reasons, including low printer noise, capability of high-speed recording and multi-color recording.

BRIEF DESCRIPTION OF THE DRAWINGS

Features of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
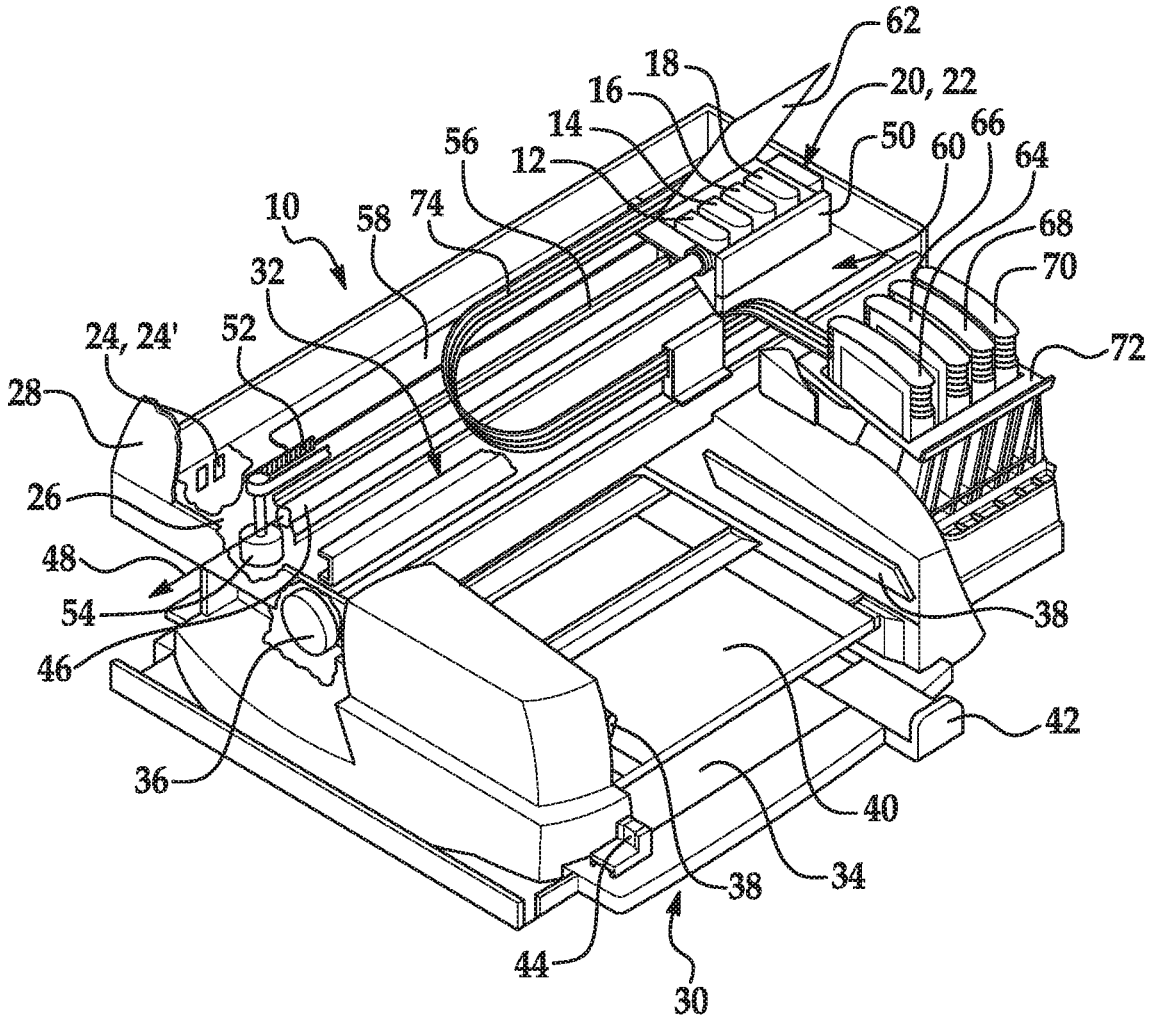
FIG. 1 is a cutaway perspective view of an example of the printer disclosed herein.

Some photo paper includes a barcode on the back side of the paper. When used in a printer having barcode media detection technology, the printer can read the barcode and identify the type of photo paper. Barcode technology may not be suitable for office paper, in part because office paper may be somewhat transparent (i.e., the barcode may be visible on the opposite side of the paper), may be used in duplex printing (e.g., where it may be undesirable to have a barcode present with the printed text and/or image). Adding barcodes to individual sheets of office paper may also be expensive.

Examples of the printer disclosed herein can detect, in real time, the type of recording medium that is to be printed on during the execution of a print job without a barcode being printed on the medium. As such, the examples disclosed herein may be particularly suitable for use with office paper (although any inkjet recording medium may be detected using the examples disclosed herein).

Two examples of office paper include plain paper and enhanced paper. As used herein, "plain paper" refers to paper that has not been specially coated or designed for specialty uses (e.g., photo printing). Plain paper is generally composed of cellulose fibers and fillers. In contrast to an enhanced paper (described below), plain paper does not include an additive that produces a chemical interaction with a pigment in an ink that is printed thereon. Also as used herein, "enhanced paper" refers to paper that has not been specially coated, but does include the additive that produces a chemical interaction with a pigment in an ink that is printed thereon. The enhanced paper is generally composed of cellulose fibers, fillers, and the additive. An example of the additive is calcium chloride or another salt that instantaneously reacts with an anionic pigment present in the ink printed on the enhanced paper, which causes the pigment to crash out of the ink and fixes the pigment on the enhanced paper surface. As an example, the enhanced paper may be any standard paper that incorporates ColorLok® Technology (International Paper Co.). Both plain paper and enhanced paper are commercially available as general office printer and/or copier papers, but, as previously mentioned, the enhanced paper incorporates the ColorLok® Technology.

As mentioned above, the examples disclosed herein may be particularly suitable for use with both plain paper and enhanced paper. After detecting the medium and prior to executing the print job, the printer(s) disclosed herein can make adjustments to print setting(s) based upon the type of recording medium that is detected. These adjustments can improve the print quality, as the performance of the ink may be highly dependent upon the type of media that is being printed upon. For example, a colormap and ink loading suitable for an enhanced paper may create a wet and soggy print when used to print an image on plain paper. In this example, automatic detection of the plain paper enables the printer to implement a customized colormap and/or ink loading for the plain paper, which improves the print quality of the image that is formed on the plain paper.

Referring now to FIG. 1, an example of a printer 10 is depicted. It is to be understood that the printer 10 may include additional components and that some of the components described herein may be removed and/or modified. Moreover, the printer 10 components may vary from model to model. Furthermore, components of the printer 10 depicted in FIG. 1 may not be drawn to scale and thus, the printer 10 may have a different size and/or configuration other than as shown therein.

In an example, the printer 10 includes an inkjet applicator 12, 14, 16, 18 to deposit ink to form a line or a dot on a recording medium (not shown), a vision system 20 including an image sensor 22 (see FIG. 2 for more details) to capture a digital image of the line or the dot; and a microprocessor 24 operatively connected to at least the image sensor 22, the microprocessor to: digitally measure, from the digital image, a width of the line, a diameter of the dot, an area of the dot, or a perimeter of the dot; identify a type of the recording medium based on the width, the diameter, the area, or the perimeter; and select a print setting for the type of the recording medium in response to the type of the recording medium being identified. Each of the components 12-18, 20, 22, and 24 will be described in more detail in reference to FIG. 1 and/or FIG. 2, along with other printer 10 components.

The printer 10 may include a chassis 26 surrounded by a housing or casing enclosure 28, the majority of which has been omitted from FIG. 1 for clarity in viewing the internal components of the printer 10.

In the printer 10, a recording media handling system 30 feeds sheets of the recording medium through a print/image zone 32. As mentioned above, the recording medium may be office paper, such as plain paper or enhanced paper, or photo paper, or other suitable type of inkjet recording medium. The recording media handling system 30 has a media input, such as a supply or feed tray 34. A supply of the recording media may be loaded and stored in the supply tray 34 prior to printing.

A series of media advance or drive rollers (not shown) powered by a motor and gear assembly 36 may be used to move the recording medium from the supply tray 34 into the print/image zone 32 for printing. After final printing, the recording medium then lands on a pair of retractable output drying wing members 38, shown extended to receive the printed recording medium. The wing members 38 momentarily hold the newly printed recording medium above any previously printed sheets (which may be still drying) on an output tray 40 before retracting to the sides to drop the newly printed recording medium into the output tray 40. The media handling system 30 may include a series of adjustment mechanisms for accommodating different sizes of recording media, including letter, legal, A-4, etc. To secure the generally rectangular recording media sheet in a lengthwise direction along the media length, the handling system 30 may include a sliding length adjustment lever 42, and a sliding width adjustment lever 44 to secure the recording media sheet in a width direction across the media width.

The chassis 26 supports a guide rod 46 that defines a scan axis 48 and that slideably supports a carriage 50 for reciprocal movement along the scan axis 48, back and forth across the print/image zone 32. The carriage 50 may support the inkjet applicator(s) 12, 14, 16, 18 and the vision system 20. For example, the inkjet applicator(s) 12, 14, 16, 18 and the vision system 20 are mounted on the carriage 50.

The carriage 50 may be driven by a carriage propulsion system, which is shown as including an endless belt 52 coupled to a carriage drive motor 54. The carriage propulsion system may also have a position feedback system, such as an optical encoder system, which communicates carriage position signals to the microprocessor 24. An optical encoder reader may be mounted to carriage 40 to read an encoder strip 56 extending along the path of carriage travel. The carriage drive motor 54 then operates in response to control signals received from the microprocessor 24. A flexible, multi-conductor strip 58 may be used to deliver enabling or firing command control signals and/or imaging signals from the microprocessor 24 to the carriage 50 for printing and/or image capture, as described further below.

The carriage 40 may be propelled along guide rod 46 into a servicing region 60, which may house a service station unit (not shown) that provides various printhead servicing functions, such as cleaning (which may involve spitting and/or wiping), capping, etc. A variety of different mechanisms may be used to selectively bring printhead caps, wipers and primers (if used) into contact with the printheads, such as translating or rotary devices, which may be motor driven, or operated through engagement with the carriage 40.

In the print/image zone 32, the recording medium can receive ink from the inkjet applicator 12, 14, 16, 18, which may be secured in (or mounted to) the carriage 40 by a latching mechanism 62, shown open in FIG. 1. In the example shown in FIG. 1, several inkjet applicators 12, 14, 16, 18 are included, such as a black ink applicator 12 and three monochrome ink applicators, namely a cyan ink applicator 14, a magenta ink applicator 16, and a yellow ink applicator 18. The inkjet applicators 12, 14, 16, 18 may also be referred to as cartridges or pens. In the examples disclosed herein, the inks dispensed by the inkjet applicators 12, 14, 16, 18 may be pigment-based inks, which include an anionic pigment that reacts with the additive when printed on the enhanced paper.

Each of the inkjet applicators 12, 14, 16, 18 may include a reservoir for storing a supply of ink therein. The reservoirs for each applicator 12, 14, 16, 18 may contain the entire ink supply on board the printer 10 for each color, which is generally the case of a replaceable cartridge, or they may store a small supply of ink. The replaceable cartridge systems carry the entire ink supply as the applicators 12, 14, 16, 18 reciprocate over the print/image zone 32 along the scanning axis 48. Hence, the replaceable cartridge system may be considered an on-axis system. Contrarily, systems which store the main ink supply at a stationary location remote from the print zone scanning axis 48 are considered off-axis systems. In an off-axis system, the main ink supply for each color is stored at a stationary location in the printer 10, such as refillable or replaceable main reservoirs 64, 66, 68, 70, which are received in a stationary ink supply receptacle 72 supported by the chassis 26.

The inkjet applicator 12, 14, 16, 18 may also be a page-wide applicator with an off-axis ink supply system. The page-wide applicator includes a print head bar that extends the entire print/image zone 32, and thus the page-wide applicator is static during a printing operation. In one example with a page-wide applicator, the vision system 20 alone may be mounted on the carriage 50 for reciprocal movement along the scan axis 48, back and forth across the print/image zone 32. In another example with a page-wide applicator, the carriage 50 may not be used, and the vision system 20 may be mounted on one end of the page-wide applicator, e.g., at the leading edge of the paper.

Each of the inkjet applicators 12, 14, 16, 18 has a respective printhead (not shown), which ejects ink delivered from the on board reservoir or via a conduit or tubing system 74 from the main reservoirs 64, 66, 68, 70.

The printheads each have an orifice plate with a plurality of nozzles formed therethrough. The nozzles of each printhead may be formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 48, with the length of each array determining the maximum image swath for a single pass of the printhead. The printheads may be thermal inkjet printheads or piezoelectric printheads.

Figure 2A:
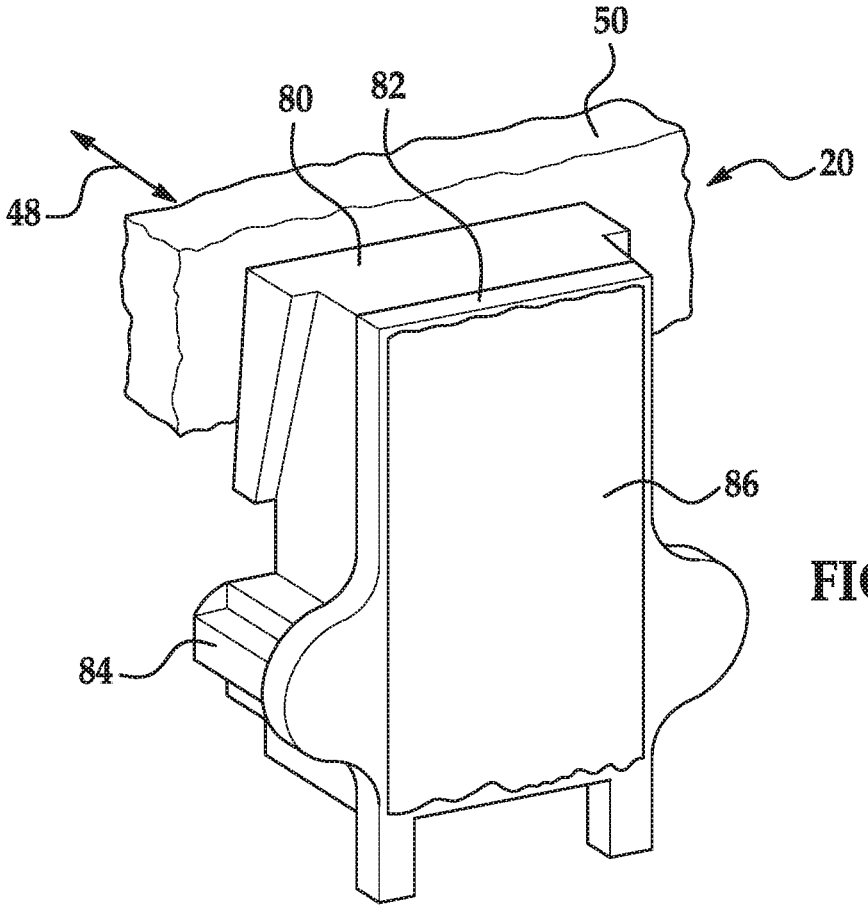
FIG. 2A is an enlarged, cutaway perspective view of an example of the exterior of a vision system disclosed herein.
Figure 2B:
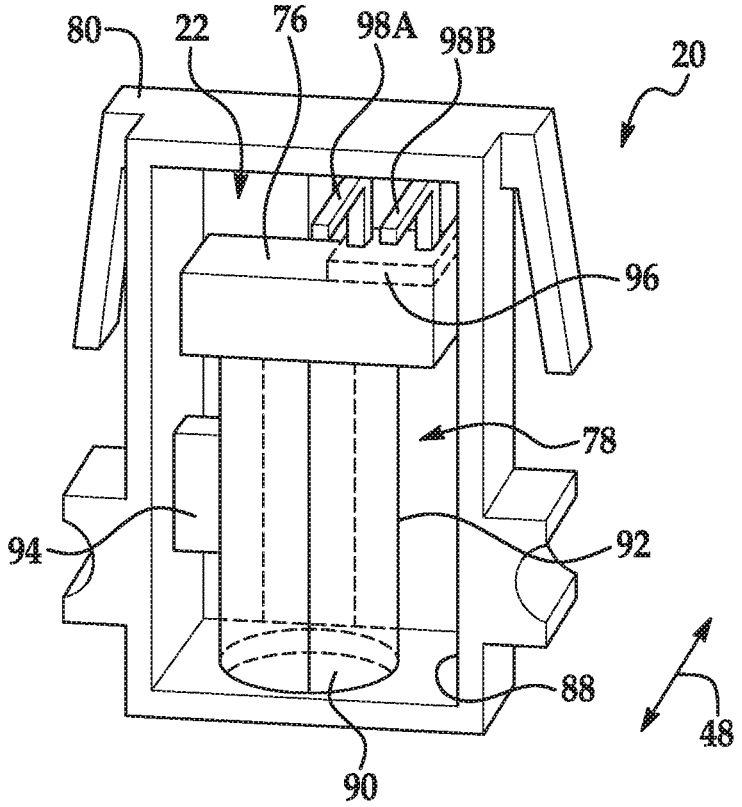
FIG. 2B is an enlarged, cutaway perspective view of an example of the interior of a vision system disclosed herein.

In the print/image zone 32, a test print formed on the recording medium can be imaged by the vision system 20, which is shown in more detail in FIGS. 2A and 2B. The vision system 20 includes at least the image sensor 22. The image sensor 22 is a digital camera 76 or a digital microscope 78. Both the digital camera 76 and the digital microscope 78 are shown in FIG. 2B, because the digital microscope 78 includes a digital camera 76. It is to be understood, however, that the digital camera 76 may be integrated into the visions system 20 without the digital microscope components.

Referring now to FIG. 2A, the vision system 20 includes a case or base unit 80 which may be supported by the carriage 50, for instance using a screw attachment, slide and snap fittings, by bonding with an adhesive or constructed integrally therewith, or in a variety of other mounting or securing mechanisms. A cover 82 may be attached to the base unit 80, for instance by a pair of snap fit fingers, such as finger 84 in FIG. 2A. In an example, base unit 80 and the cover 82 may both be constructed of an injection molded rigid plastic, although other materials may also be suitably employed. Overlying the cover 84 may be a flex circuit assembly 86, which may be used to provide power to the vision system 20, and to deliver imaging signals back to the microprocessor 24. The flex circuit 86 may couple the vision system 20 to an electronics portion (not shown) of the carriage 50, with the imaging signals then passing from the carriage 50 through the multi-conductor strip 58, which also carries communication signals between the microprocessor 24 and the carriage 50 to fire the printheads.

As shown in FIG. 2B, the interior portion 88 defined by the base unit 80 houses the digital camera 76 and/or digital microscope 78.

Whether used alone or as part of the digital microscope 78, the digital camera 76 may be any digital camera, for example, a CMOS (Complementary Metal Oxide Semiconductor) sensor type digital camera, a CCD (Charge Coupled Device) sensor type digital camera, or the like.

The digital microscope 78 components may include the digital camera 76, an extension tube 92, a tube lens 90, and a light source 94.

The tube lens 90 may include several lens elements, apertures, etc., in order to provide a desirable magnification and resolution of the image that is to be taken. In an example, the tube lens 90 includes several lenses, some of which make up an objective section, and the other of which make up a zoom section. In other instances, the digital microscope 78 may further include a separate objective attached to the tube lens 90.

The extension tube 92 magnifies an image of the test print, and transfers the image to sensors of the digital camera 76. A zoom body tube may be used as the extension tube 92. The extension tube 92 may have a low, a medium or a high magnification ratio, or may have a long distance focus function or a polarization function, or may have any desired functions.

The digital camera 76 (when used alone or as a digital microscope component) converts the (analogue) image transferred from the extension tube 92 into digital image data. In an example, the digital camera 76 is a C-mount type of digital camera which is fixed to the extension tube 92.

The light source 94 may be included to irradiate observing-light to the test print being imaged. The light source 94 may be an optical fiber, or a light emitting diode (LED), or another suitable illuminant which illuminates the printed region being analyzed.

Referring back to FIG. 1, as mentioned above, the printer 10 includes the microprocessor 24, which is a printer controller that receives instructions from a host device, which may be a computer, such as a personal computer or a laptop (not shown). At least some of the microprocessor 24 functions may be performed by the host computer, by the electronics on board the printer 10, or by interactions therebetween. As used herein, the term "microprocessor 24" encompasses these functions, whether performed by the host computer, the printer 10, an intermediary device therebetween, or by the combined interaction of these elements. A monitor coupled to the computer host may be used to display visual information to an operator or user, such as the printer status or a particular program being run on the host computer.

In one example of the printer 10, the microprocessor 24 is a single microprocessor that controls print operations as well as recording media identification operations. The single microprocessor may process print data (e.g., from the host device) that is based on text and/or an image that is to be generated via the printer 10. In response to processing the print data, the single microprocessor may control the operations of the inkjet applicator(s) 12, 14, 16, 18 to first generate a test print, and ultimately to generate a final print.

When print data is received from the host device, the single microprocessor causes the inkjet applicator(s) 12, 14, 16, 18 to print the test print, where the test print includes a line and/or a dot (e.g., a single dot or a cluster of several dots). In an example, the layout of the test print may be pre-defined and transmitted to the microprocessor as part of the print data. In another example, the layout of the test print may be user defined (e.g., by a user who is operating a particular program being run on the host computer), and transmitted to the microprocessor as part of the print data.

When the test print is generated, the series of media advance or drive rollers may move the recording medium (now having the test print printed thereon) into a suitable position within the print/image zone 32, so that the image sensor 22 can capture a digital image of the test print. For example, the recording medium may be advanced forward or backward in a direction perpendicular to the scan axis 48 in order to substantially align the test print with the scan axis 48, and thus with the carriage 50 which traverses the scan axis 48.

The single microprocessor commands the carriage 50 to at least substantially align the vision system 20 with the test print, and commands the image sensor 22 to capture the digital image of the test print (i.e., of the line and/or the dot(s)). Either the digital camera 76 or the digital microscope 78 will capture the digital image. An imaging signal may be sent from the image sensor 22 to the single microprocessor indicating that the digital image has been captured.

The single microprocessor may then i) digitally measure, from the digital image, a width of the line, a diameter of the dot, an area of the dot, or a perimeter of the dot; ii) identify a type of the recording medium based on the width, the diameter, the area, or the perimeter; and iii) select a print setting for the type of the recording medium in response to the type of the recording medium being identified. The print setting is for the print job involving the identified type of the recording medium, and the single microprocessor is to select an ink colormap, a print mode, an ink loading, or combinations thereof as the print setting in response to identifying type of the recording medium. Each of these functions will be described further in reference to FIG. 3.

Once the print setting is selected, the single microprocessor may process the print data to generate the final print (e.g., on a new sheet of the identified type of recording medium, or on the same sheet as the test print if the test print will not interfere with the final print that is to be generated).

In another example of the printer 10, the microprocessor 24 includes an image microprocessor 96 (shown in FIG. 2B) operatively connected to the image sensor 22, and a printer microprocessor 24' (shown in FIG. 1) operatively connected to the image microprocessor 96; where the image microprocessor 96 is to perform the digitally measuring and the identifying, and the printer microprocessor 24' is to perform the selecting in response to the type of the recording medium being identified. More generally, in this example, the image microprocessor 96 controls the recording media identification operations and the printer microprocessor 24' controls the print operations.

Referring briefly to FIG. 2B, in this example, the image sensor 22 and the microprocessor 96 are components of the visions system 20 of the printer 10. The image microprocessor 96 may be operatively connected to the printer microprocessor 24' through the flex circuit assembly 86. The image microprocessor 96 may be operatively connected to two output leads 98A, 98B, which are electrically coupled to conductors in the flex circuit 86 for instance by soldering, crimping, or other electrical connection techniques. Through the leads 98A, 98B and the flex circuit 86, the image microprocessor 96 can receive signals (e.g., indicating that the test print has been generated) from the printer microprocessor 24', and can transmit signals (e.g., indicative of the identified type of recording medium) to the printer microprocessor 24'.

In this example, the printer microprocessor 24' may process the print data (e.g., from the host device) that is based on text and/or an image that is to be generated via the printer 10. In response to processing the print data, the printer microprocessor 24' may control the operations of the inkjet applicator(s) 12, 14, 16, 18 to first generate a test print, and ultimately to generate a final print.

When print data is received from the host device, the printer microprocessor 24' commands the inkjet applicator(s) 12, 14, 16, 18 to print the test print, where the test print includes a line and/or a dot (e.g., a single dot or a cluster of several dots). As previously described herein, when the test print is generated, the series of media advance or drive rollers may move the recording medium (now having the test print printed thereon) into a suitable position within the print/image zone 32, so that the image sensor 22 can capture a digital image of the test print.

The printer microprocessor 24' may transmit a signal to the image microprocessor 96 indicating that the test print has been printed. In response, the image microprocessor 96 commands the carriage 50 to at least substantially align the vision system 20 with the test print, and causes the image sensor 22 to capture the digital image of the test print (i.e., of the line and/or the dot(s)). Either the digital camera 76 or the digital microscope 78 will capture the digital image.

The image microprocessor 96 may then i) digitally measure, from the digital image, a width of the line, a diameter of the dot, an area of the dot, or a perimeter of the dot; and ii) identify a type of the recording medium based on the width, the diameter, the area, or the perimeter. In this example, the capturing, the measuring, and the identifying are accomplished by the vision system 22 of the printer 10. In this example, image microprocessor 96 may also transmit the identified type of the recording medium to the printer microprocessor 24'.

As mentioned above, in this example, the printer microprocessor 24' performs the print operations. One of these operations involves selecting the print setting for the identified type of the recording medium. The print setting is for the print job involving the identified type of the recording medium, and the printer microprocessor 24' is to receive the identified type of the recording medium from the image microprocessor 96, and in response to receiving the identified type of the recording medium, select an ink colormap, a print mode, an ink loading, or combinations thereof as the print setting.

Once the print setting is selected, the printer microprocessor 24' may process the print data to generate the final print (e.g., on a new sheet of the identified type of recording medium, or on the same sheet as the test print if the test print will not interfere with the final print that is to be generated).

While not shown, the printer 10 may further include a non-transitory computer readable medium (e.g., a data store) accessible by the microprocessor 24 (or 24' and 96), and a lookup table including a known set of widths, a known set of diameters, a known set of areas, a known set of perimeters, or combinations thereof stored on the non-transitory, computer readable medium; wherein the microprocessor 24 or 96 is to identify the type of the recording medium by comparing the width, the diameter, the area, or the perimeter with the known set of widths, the known set of diameters, the known set of areas, the known set of perimeters, respectively. The non-transitory computer readable medium may also store other computer or machine readable instructions executable by the microprocessor 24 or 24', 96, such as a program for measuring line width, dot diameter, dot area, and/or dot perimeter. The non-transitory computer readable medium may be on board the printer 10, or may be off board the printer 10 (e.g., as part of the host device).

Figure 3:
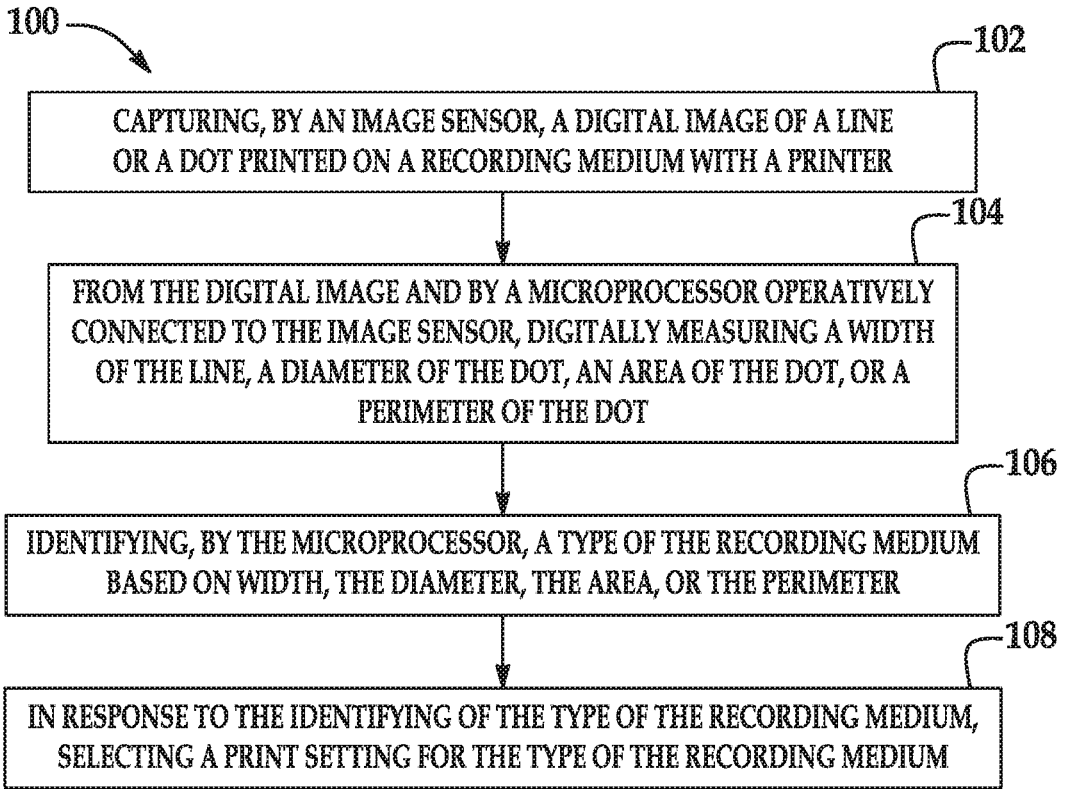
FIG. 3 is a flow diagram of an example of a recording medium identification method.

Referring now to FIG. 3, a recording medium identification method is depicted at reference numeral 100. As shown, the recording medium identification method includes capturing, by an image sensor 22, a digital image of a line or a dot printed on a recording medium with a printer 10 (reference numeral 102); from the digital image and by a microprocessor 24 or 96 operatively connected to the image sensor 22, digitally measuring a width of the line, a diameter of the dot, an area of the dot, or a perimeter of the dot (reference numeral 104); identifying, by the microprocessor 24 or 96, a type of the recording medium based on the width, the diameter, the area, or the perimeter (reference numeral 106); and in response to the identifying of the type of the recording medium, selecting a print setting for the type of the recording medium (reference numeral 108).

As previously described herein, the line or dot may be printed as a test print at the outset of a print job that is being executed by the printer 10. In an example, a line, a single dot, or a cluster of dots may be printed. In an example, the line may be printed parallel with (i.e., in the direction of) the scan axis 48. In this example, a single nozzle may fire at every pixel location across any length of the scan axis 48 to generate a line. Additional adjacent nozzles may be fired simultaneously, which will widen the line. In another example, the scanning inkjet applicator 12, 14, 16, 18 fires all nozzles of a single color one time to form a line. This can be done at various locations along the scan axis 48 to achieve multiple lines. In this example, thicker (wider) lines may be formed by repeatedly firing every nozzle again at subsequent pixel locations. In an example, the printed lines or dots may be as wide as 1 row of nozzles or 2 staggered rows of nozzles.

The line or cluster of dots may be printed at a resolution ranging from about 300 dots per inch (dpi) to about 1200 dpi. The length of the line may extend as far in a direction that is perpendicular to the scan axis 48 that is desirable for obtaining a suitable image and so that the dimensions of the line are readable by the vision system 20. In an example, the printed lines range from about 0.2 cm to about 0.4 cm in length.

In the examples disclosed herein, distinguishable lines and/or dots may be formed using a single color ink (e.g., black, cyan, magenta, yellow, or another color), or several color inks. The media detection can be performed as long as any single color ink in the printer 10 can generate dots or lines distinguishable by the on-board vision system 20. In some examples, the printer 10, such as a web press, may also include a separate applicator (similar to inkjet applicator 12, 14, 16, 18) with a designated ink intended exclusively for media detection.

The image sensor 22, i.e., the digital camera 76 or the digital microscope 78 captures the digital image of the printed line or dot(s).

From the digital image, the microprocessor 24 or 96 identifies the line or a portion of the line or the dot(s) that are to be measured, and then digitally measures the width of the line or line portion, or the diameter, area and/or perimeter of the dot(s).

In an example, the microprocessor 24 or 96 may operate a program to measure the line width in accordance with a then-current standard for measuring line width. It may be desirable for the then current standard to be an International standard by the International Organization for Standardization (ISO). For example, microprocessor 24 or 96 may operate a program to measure the line width in accordance with ISO-13660 standard for line width measurement. ISO 13660 uses a dynamic threshold, which involves calculating the threshold for each measurement based on the measured paper reflectance value (Rmax) and line reflectance value (Rmin). Dynamic thresholding is used to define locations along the line reflectance profile, e.g., a 50% dynamic threshold would cross the line reflectance profile at the reflectance level half way between Rmin and Rmax. According to ISO 13660, line width is calculated as the 60% threshold from one edge to the other edge in microns.

The microprocessor 24 or 96 may also operate a program to measure the dot diameter, dot area, and/or dot perimeter in accordance with a then-current standard for measuring the respective dot characteristic. Dot area is the area (e.g., pmt) of a background dot. Dot diameter (μm) may be computed from the dot area according to the following equation: D=SQRT (4*area/pi). This is an equivalent circular diameter and correlates well to the diameters of background particles, which are approximately circular. The perimeter (i.e., circumference) (μm) is the length of the outside boundary of the background particle. The perimeter may be computed from the diameter according to the following equation: P=D*pi.

Based on the measured width, the diameter, the area, or the perimeter, the microprocessor 24 or 96 can identify the type of the recording medium then-currently in use. In the examples disclosed herein, it has been found that inks exhibit a distinct and significant difference in line width, dot diameter, dot area, and dot perimeter when printed on plain paper and when printed on enhanced paper. This difference is used in the examples disclosed herein to identify the type of media that the line or dot has been test printed on. In an example, the identifying involves respectively comparing the width, the diameter, the area, or the perimeter with a known set of widths, a known set of diameters, a known set of areas, or a known set of perimeters. These known sets may be stored in a lookup table in the non-transitory computer readable medium and may be accessible by the microprocessor 24 or 96.

The lookup table may be organized by the type of media (e.g., specific brands of plain paper and enhanced paper). In one example, all plain papers will be associated with an average line width, an average dot diameter, an average dot area, and/or an average dot perimeter and all enhanced papers will be associated with an average line width, an average dot diameter, an average dot area, and/or an average dot perimeter. In another example, different brands of each type of media (plain or enhanced) may be associated with its own average line width, an average dot diameter, an average dot area, and/or an average dot perimeter. The average values may be based upon several test prints for each of the recording media types. For example, several lines may be printed on different sheets of the same brand of plain paper using the printer 10 or the same type of printer 10. The digital image of each line may be taken, and the width measured. The average width of all the measurements is calculated and stored in the lookup table for the particular brand of plain paper. For a meaningful comparison, the measurements of the test print and measurements for the known sets of data should be measured in the same way. As such, the known sets of data may be created based on measurements using the same standard for line width, dot diameter, dot area, and/or dot perimeter that is used by the microprocessor 24 or 96. Generation of the known sets of data is discussed further in reference to FIG. 5.

The microprocessor 24 or 96 accesses the lookup table and queries the lookup table using the measured the line width, dot diameter, dot area and/or dot perimeter of the test print. A comparison of the measured line width, dot diameter, dot area and/or dot perimeter of the test print is performed with the average line widths, the average dot diameters, the average dot areas and/or the average dot perimeters stored in the lookup table. The matching or closest known value to the measured value is identified, and the recording medium associated with that matching or closest known value is also identified. This comparison tells the printer 10 what type of recording media is then-currently being used.

In response to the identification of the recording medium type, the printer 10 (more specifically, the microprocessor 24 or 96) selects a print setting for the identified recording medium. The print setting is for the print job involving the identified type of the recording medium, and the selecting involves selecting an ink colormap, selecting a print mode, selecting an ink loading, or combinations thereof.

Figure 4:
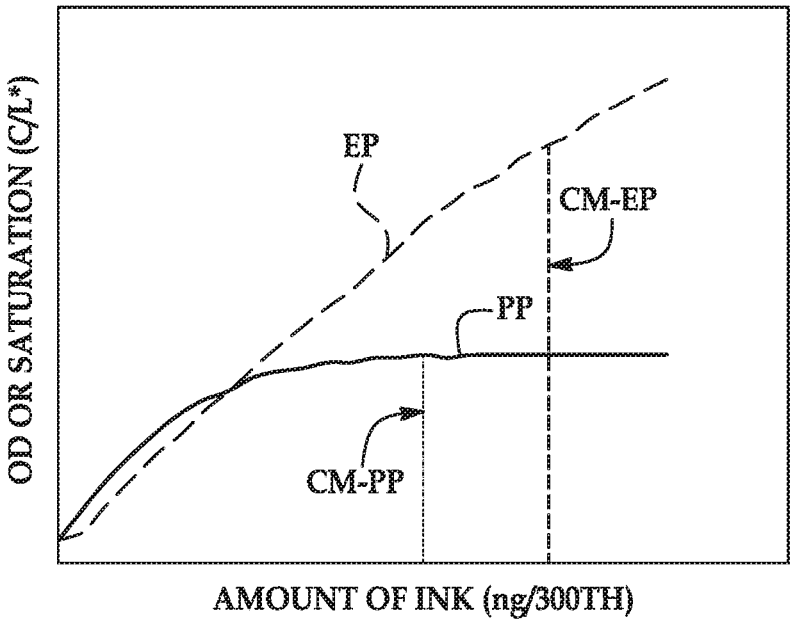
FIG. 4 is a graph schematically depicting optical density or saturation (in C/L*) as a function of the amount of ink (in ng/300$^{th}$) for prints on different media types when no media detection is available and when an example of media detection disclosed herein is available.

The ink colormap is a function or algorithm that maps (transforms) the colors of the host device (e.g., as seen on a monitor) to the colors of the printer 10. When a single colormap is included in a printer, the colormap may be designed for a particular media type, and thus the printer may use too much ink or too little ink with respect to the particular media type, which can lead to undesirable print quality and/or undesirable ink usage. In the examples disclosed herein, the printer 10 may include two colormaps, one designed for plain paper and one designed for enhanced paper. FIG. 4 is a graph schematically illustrating the effect of the single colormap versus the effect of the two colormaps, and thus there are no units on the axes. FIG. 4 illustrates optical density ("OD") or saturation (C/L*) versus the amount of ink (ng/300$^{th}$, where ng/300$^{th}$ means nanograms of ink per 300 dpi sized pixel location or 1/300th inch cell). The dashed line labelled "EP" is an example of the amount of ink needed to achieve a particular optical density or saturation for an enhanced paper. The solid line labelled "PP" is an example of the amount of ink needed to achieve a particular optical density or saturation for a plain paper. The line labeled "CM-EP" represents the colormap for enhanced paper, and the line labeled "CM-PP" represents the colormap for plain paper.

As illustrated in this example, the colormap for plain paper CM-PP specifies lower ink loadings than the colormap for enhanced papers CM-EP. When a printer includes the single colormap for enhanced papers CM-EP, the ink loading selected is in accordance with this colormap CM-EP, regardless of the type of media actually being used. Thus, in this example and when plain paper is used, more ink is utilized than is needed to achieve a desirable OD or saturation on the plain paper. In contrast, detecting the recording medium in accordance with the examples disclosed herein allows the printer 10 to select between the two colormaps CM-EP and CM-PP based on the type of media actually being used. Thus, less ink may be used when plain paper is detected and more ink may be used when enhanced paper is detected in order to achieve the desirable OD or saturation for the type of media actually being used. The plain paper colormap and the associated lower ink loadings may be desirable so that the generated prints are not soggy and wet (e.g., which may result when the printer has a single colormap). Moreover, the plain paper colormap and the associated lower ink loading can improve the image quality, in part because the printed inks are less likely to bleed or coalesce in an undesirable manner.

Referring back to FIG. 3 (reference numeral 108), the print mode may include the print speed, the number of print passes, and the dots per inch that are printed. The print mode may be selected to produce a high quality print on the identified medium type.

As previously described, the ink loading may depend, in part, on the selected colormap.

In an example of the method 100, the identified type of the recording medium is a paper including an additive that produces a chemical interaction with a pigment in an ink (i.e., an enhanced paper), and a dedicated ink colormap for the paper including the additive is selected. In another example of the method 100, the identified type of the recording medium is a plain paper, and a dedicated ink colormap for the plain paper is selected.

In response to media identification and selection of a suitable print setting (e.g., correct colormap and ink loading), the printer 10 then completes the print job.

In an example, the method 100 may be performed one time for an entire stack of the recording media loaded in the feed tray 34 of the printer 10. In this example, the printer 10 may be equipped with a sensor (not shown) that recognizes when the feed tray 34 is emptied and refilled. Upon recognizing that a new recording medium/media is put into the feed tray 43, the printer 10 may perform the method 100 in order to identify the newly input recording medium/media. In another example, the method 100 may be performed for each newly received print job. In this example, prior to executing a then-current print job, the printer 10 may perform the method 100 using a top most piece of the recording media loaded into the feed tray 34. In still another example, the method 100 may be performed on each individual recording medium sheet. In this example, the individual sheets can be identified by pulling the leading edge of the paper into the print zone 32, and the method 100 may be performed prior to executing the portion of the print job for that sheet.

Figure 5:
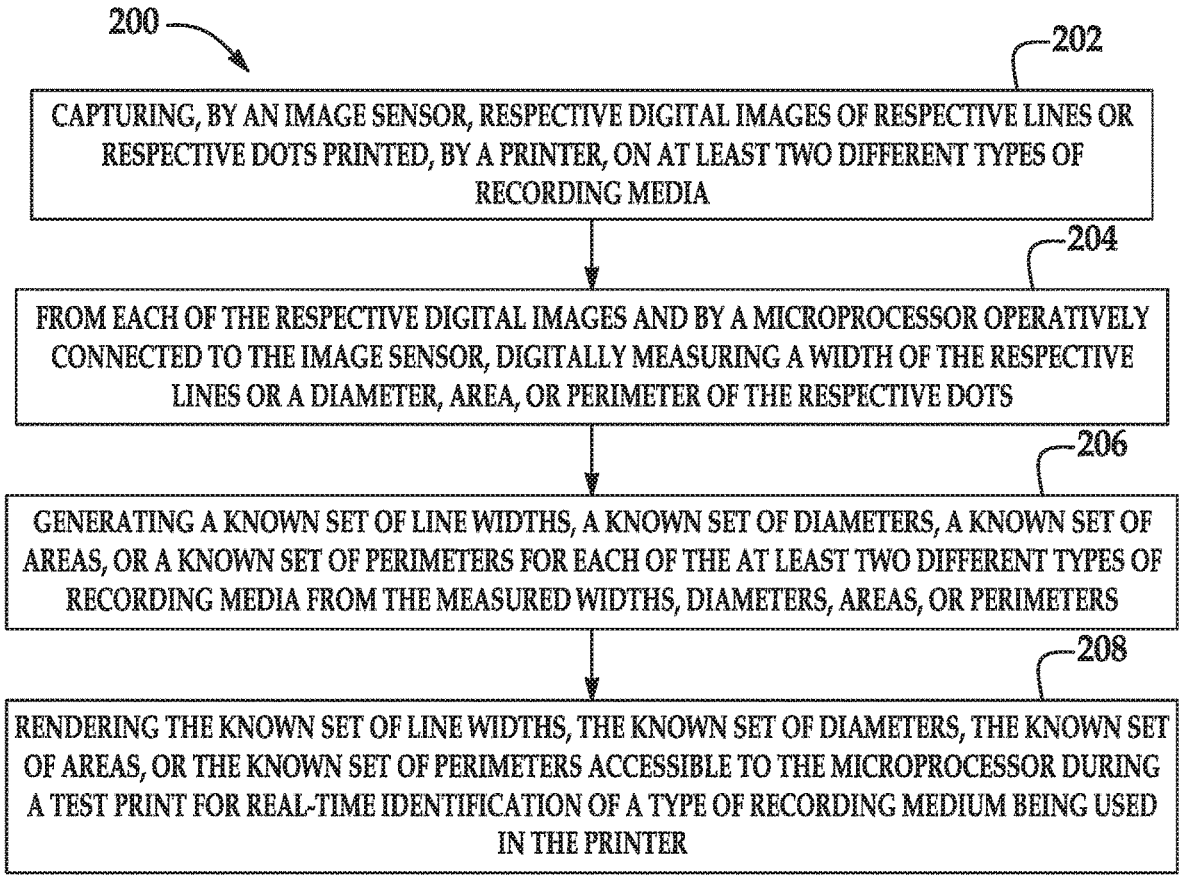
FIG. 5 is a flow diagram of another example of a method disclosed herein.

Referring now to FIG. 5, a method for generating the known set of widths, diameters, areas, and/or perimeters is depicted at reference numeral 200. As shown, the method includes capturing, by an image sensor 22, respective digital images of respective lines or respective dots printed, by a printer 10, on at least two different types of recording media (reference numeral 202); from each of the respective digital images and by a microprocessor 24, 96 operatively connected to the image sensor 22, digitally measuring a width of the respective lines or a diameter, area, or perimeter of the respective dots (reference numeral 204); generating a known set of line widths, a known set of diameters, a known set of areas, or a known set of perimeters for each of the at least two different types of recording media from the measured widths, diameters, areas, or perimeters (reference numeral 206); and rendering the known set of line widths, the known set of diameters, the known set of areas, or the known set of perimeters accessible to the microprocessor 24, 24', 96 during a test print for real-time identification of a type of recording medium being used in the printer 10.

The printer 10 or a similar type of printer as printer 10 may be used to generate the known sets of data. Lines and dots may be printed on several sheets of the same type of paper in order to create several printed images. Digital images of the printed images are captured, as described herein.

From the digital images of the lines, the widths are measured and an average is taken to calculate the average line width values. From the digital images of the dots, the diameters, areas, and/or perimeters are measured and an average is taken to calculate the average dot diameter values, the average dot area values, and/or the average dot perimeter values. As mentioned above, the digital measurements taken to generate the known sets of data should utilize the same standard that is to be used when measuring the digital image of the test print.

In one example, all of the data accumulated from digital images of the lines and/or dots printed on the sheets of plain paper (regardless of the brand) may be averaged to generate the known line width, the known dot diameter, the known dot area, and/or the known dot perimeter for plain paper. Similarly, all of the data accumulated from digital images of the lines and/or dots printed on the sheets of enhanced paper (regardless of the brand) may be averaged to generate the known line width, the known dot diameter, the known dot area, and/or the known dot perimeter for enhanced paper. In another example, the accumulated line and/or dot data may be for a specific brand of each type of media (plain or enhanced). For example, lines and dots may be printed on several sheets of HP Multi-Purpose enhanced paper, and their digital images captured. All of the data measured from these images may be averaged to generate the known line width, the known dot diameter, the known dot area, and/or the known dot perimeter for the HP Multi-Purpose enhanced paper. For another example, lines and dots may be printed on several sheets of Staples copy paper (a plain paper), and their digital images captured. All of the data measured from these images may be averaged to generate the known line width, the known dot diameter, the known dot area, and/or the known dot perimeter for the Staples copy paper. The print, capture, measure, and average process may be performed for any number of different plain and/or enhanced papers.

The generated known set of line widths, diameters, areas, and/or perimeters is then stored so that the microprocessor 24, 24', 96 can access the known set(s) during a test print for real-time identification of a type of recording medium being used in the printer 10. In an example, the known sets of data are stored in the non-transitory, computer readable medium.

To further illustrate the present disclosure, an example is given herein. It is to be understood that this example is provided for illustrative purposes and is not to be construed as limiting the scope of the present disclosure.

EXAMPLE

A series of lines was printed. The lines were 1200 dpi pixel wide lines. The 1200 dpi pixel wide line contained a single drop per nozzle for a color. In the printer used in this example, there were 2 nozzle columns, each containing 784 nozzles (1568 total nozzles). The nozzle spacing was 1200 nozzles per square inch (1200 npi), and thus the vertical resolution was 1200 dpi.

Two different black inks, cyan inks, magenta inks, and yellow inks were used. For each of the eight inks, eight unique line swaths were printed on each type of recording media. One enhanced paper was used, namely HP Multi-Purpose paper with ColorLok (i.e., Enhanced Paper). Two plain papers were used, namely Staples copy paper (Plain Paper 1) and Boise Smooth offset uncoated paper (Plain Paper 2).

The top half of each line followed two area fill boxes, which eliminated potential evaporative decap defects in the printed line that could perturb line width measurement. As such, the top half of each line was digitally imaged using a PIAS II digital microscope. The PIAS II digital microscope was used to measure the line width of each line from the respective digital images. The following settings were used on the PIAS II digital microscope: Outer=10%, Edge=40%, Density=75%, and Inner=90%. These settings use relative reflectance of the line to calculate line properties, such as line width, blur, and edge raggedness. These settings can be adjusted to comply with the ISO-13660 standard for line width (Inner: 90% Outer 10%, Edge 60%, Density 75%). The details for how the Inner, Outer, Edge, and Density values all factor into the line width measurement are set forth in the ISO-13660 standard. In this example, the Edge setting was set at 40% rather than 60%. Lowering the Edge setting from 60% to 40% increased the signal by measuring more of the line.

The average line width measurements are shown in Table 1. The average line width is calculated from the measured line width of each of the eight unique line swaths for each ink on each type of recording medium.

TABLE 1

| | Average Line Width (μm) | | | | |
|---|---|---|---|---|---|
| | Enhanced Paper | Plain Paper (PP) | | Difference in Line Width | |
| Ink | (EP) | 1 | 2 | EP vs. PP1 | EP vs. PP2 |
| Black Ink 1 | 118.8 | 141.9 | 144.3 | 23.1 | 25.5 |
| Black Ink 2 | 131.6 | 154.3 | 150.0 | 22.7 | 18.4 |
| Cyan Ink 1 | 113.1 | 136.0 | 132.5 | 22.9 | 19.4 |
| Magenta Ink 1 | 112.5 | 132.3 | 130.4 | 19.8 | 17.9 |
| Yellow Ink 1 | 139.4 | 154.3 | 156.6 | 14.9 | 17.2 |
| Cyan Ink 2 | 133.0 | 147.6 | 146.1 | 14.6 | 13.1 |
| Magenta Ink 2 | 122.9 | 143.1 | 142.5 | 20.2 | 19.6 |
| Yellow Ink 2 | 137.3 | 167.8 | 159.8 | 30.5 | 22.5 |
| Average Difference | | | | 21.1 | 19.2 |

Figure 6A:
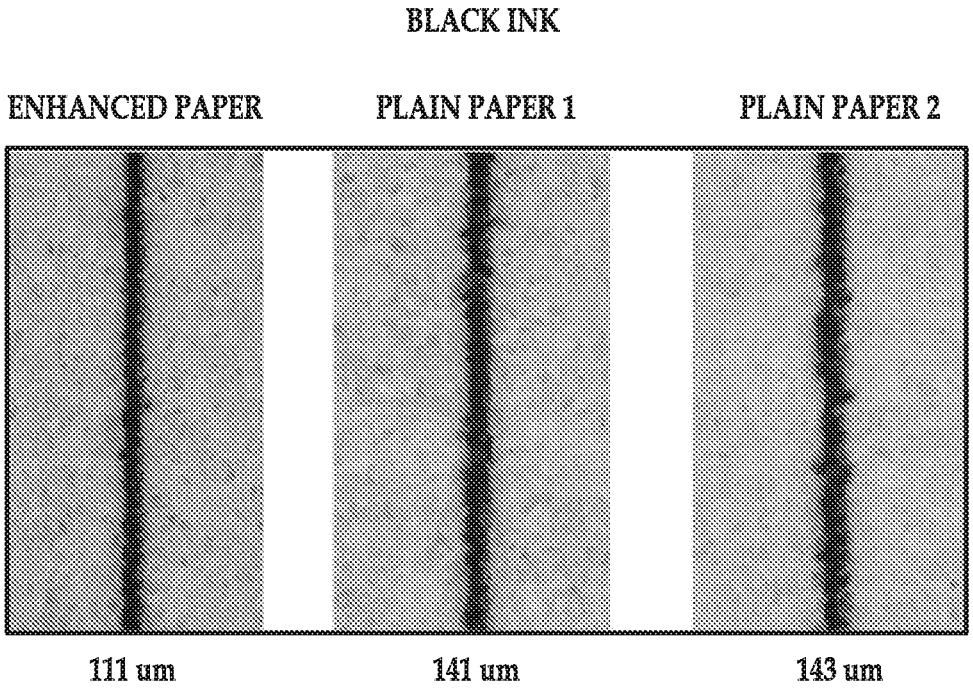
FIG. 6A is a black and white representation of originally colored digital microscope images of a line printed with black ink on three different types of recording media.
Figure 6B:
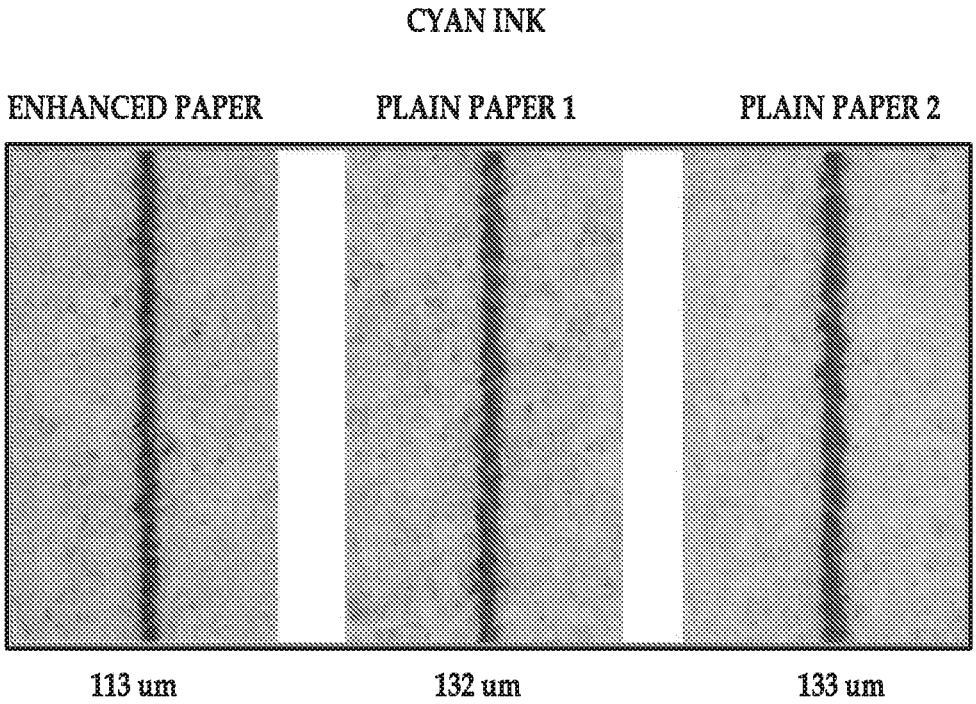
FIG. 6B is a black and white representation of originally colored digital microscope images of a line printed with cyan ink on three different types of recording media.

FIG. 6A depicts a black and white representation of the digital images of one of the lines printed with Black Ink 1 on each of the recording media. FIG. 6B depicts a black and white representation of the digital images of one of the lines printed with Cyan Ink 1 on each of the recording media. These figures also show the measured line width for these particular lines/images.

The data in Table 1 illustrates that there is a distinct difference in the line width on the Enhanced Paper and both of Plain Papers 1 and 2. These differences were observed with each of the ink colors and ink types. This example illustrates that the line width data may be used to distinguish enhanced paper from plain paper during a printing process.

The examples disclosed herein may be used for automatic in-printer detection of the recording media type, especially for identifying enhanced and plain paper office media. By measuring the line width or drop characteristic(s) (i.e., diameter, area, and/or perimeter), the printer's microprocessor 24 or 96 can determine the office media type and select highly customized colormaps and other print settings to generate a high quality image with a suitable amount of ink.

It is to be understood that the ranges provided herein include the stated range and any value or sub-range within the stated range. For example, a range from about 0.2 cm to about 0.4 cm should be interpreted to include not only the explicitly recited limits of from about 0.2 cm to about 0.4 cm, but also to include individual values, such as 0.26 cm, 0.3 cm, 0.375 cm, etc., and sub-ranges, such as from about 0.21 cm to about 0.39 cm, from about 0.25 cm to about 0.35 cm, etc. Furthermore, when "about" is utilized to describe a value, this is meant to encompass minor variations (up to +/−10%) from the stated value.

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

In describing and claiming the examples disclosed herein, the singular forms "a", "an", and "the" include plural referents unless the context clearly dictates otherwise.

While several examples have been described in detail, it is to be understood that the disclosed examples may be modified. Therefore, the foregoing description is to be considered non-limiting.

What is claimed is:

1. A recording medium identification method, comprising:

capturing, by an image sensor, a digital image of a line or a dot printed on a recording medium with a printer;

from the digital image and by a microprocessor operatively connected to the image sensor, digitally measuring a width of the line, a diameter of the dot, an area of the dot, or a perimeter of the dot;

identifying, by the microprocessor, a type of the recording medium based on the width, the diameter, the area, or the perimeter; and in response to the identifying of the type of the recording medium, selecting a print setting for the type of the recording medium;

wherein the print setting is for a print job involving the identified type of the recording medium, and wherein the selecting involves:

selecting an ink colormap;

selecting a print mode;

selecting an ink loading;

or combinations thereof;

and wherein the identified type of the recording medium is a paper including an additive that produces a chemical interaction with a pigment in an ink, and wherein a dedicated ink colormap for the paper including the additive is selected.

2. The recording medium identification method as defined in claim 1 wherein the image sensor and the microprocessor are components of a vision system of the printer.

3. The recording medium identification method as defined in claim 1 wherein the identifying involves respectively comparing the width, the diameter, the area, or the perimeter with a known set of widths, a known set of diameters, a known set of areas, or a known set of perimeters.

4. The recording medium identification method as defined in claim 1 wherein the image sensor is a digital camera or a digital microscope.

5. A printer, comprising:

an inkjet applicator to deposit ink to form a line or a dot on a recording medium;

a vision system including an image sensor to capture a digital image of the line or the dot;

a microprocessor operatively connected to at least the image sensor, the microprocessor to:

digitally measure, from the digital image, a width of the line, a diameter of the dot, an area of the dot, or a perimeter of the dot;

identify a type of the recording medium based on the width, the diameter, the area, or the perimeter; and select a print setting for the type of the recording medium in response to the type of the recording medium being identified;

a non-transitory, computer readable medium accessible by the microprocessor; and a lookup table including a known set of widths, a known set of diameters, a known set of areas, a known set of perimeters, or combinations thereof stored on the non-transitory, computer readable medium;

wherein the microprocessor is to identify the type of the recording medium by comparing the width, the diameter, the area, or the perimeter with the known set of widths, the known set of diameters, the known set of areas, the known set of perimeters, respectively.

6. The printer as defined in claim 5 wherein:

the microprocessor includes:

an image microprocessor operatively connected to the image sensor; and a printer microprocessor operatively connected to the image microprocessor;

the image microprocessor is to perform the digitally measuring and the identifying; and the printer microprocessor is to perform the selecting in response to the type of the recording medium being identified.

7. The printer as defined in claim 6 wherein:

the print setting is for a print job involving the identified type of the recording medium; and the printer microprocessor is to:

receive the identified type of the recording medium from the image microprocessor; and in response to receiving the identified type of the recording medium, select an ink colormap, a print mode, an ink loading, or combinations thereof as the print setting.

8. The printer as defined in claim 5 wherein:

the print setting is for a print job involving the identified type of the recording medium; and the microprocessor is to select an ink colormap, a print mode, an ink loading, or combinations thereof as the print setting in response to identifying the type of the recording medium.

9. The printer as defined in claim 5 wherein the inkjet applicator and the vision system are mounted on a carriage.

10. The printer as defined in claim 5 wherein the image sensor is a digital camera or a digital microscope.

* * * * *